US005302485A

United States Patent [19]

Swain

[11] Patent Number: 5,302,485

[45] Date of Patent: Apr. 12, 1994

[54] METHOD TO SUPPRESS PLYWOOD IN A PHOTOSENSITIVE MEMBER

[75] Inventor: Eugene A. Swain, Webster, N.Y.

[73] Assignee: Xerox Corporation, Stamford, Conn.

[21] Appl. No.: 340

[22] Filed: Jan. 4, 1993

[51] Int. Cl.[5] ..... G03G 5/10

[52] U.S. Cl. ..... 430/127

[58] Field of Search ..... 430/62, 69, 58, 131, 430/127

[56] References Cited

U.S. PATENT DOCUMENTS

| | | | |
|---|---|---|---|
| 4,076,564 | 2/1978 | Fisher | 156/664 |
| 4,134,763 | 1/1979 | Fujimura et al. | 96/1.5 R |
| 4,537,849 | 8/1985 | Arai | 430/85 |
| 4,618,552 | 10/1986 | Tanaka et al. | 430/60 |
| 4,741,918 | 5/1988 | de Nogybaczon et al. | 427/11 |
| 4,904,557 | 2/1990 | Kubo | 430/56 |
| 5,051,328 | 9/1991 | Andrews et al. | 430/56 |
| 5,069,758 | 12/1991 | Herbert et al. | 205/73 |
| 5,089,908 | 2/1992 | Jodoin et al. | 359/212 |
| 5,096,792 | 3/1992 | Simpson et al. | 430/58 |
| 5,148,639 | 9/1992 | Sakai et al. | 51/328 |
| 5,166,023 | 11/1992 | Harada et al. | 430/62 |

FOREIGN PATENT DOCUMENTS

| | | | |
|---|---|---|---|
| 4194861 | 7/1992 | Japan | G03G 5/04 |

*Primary Examiner*—John Goodrow
*Attorney, Agent, or Firm*—Zosan S. Soong

[57] ABSTRACT

A process for forming a photosensitive imaging member comprising: (a) providing a substrate; (b) forming in successive layers on the substrate, an optional intermediate layer, and one or more photosensitive layers; and (c) rotating a conditioning wheel to roughen the exterior surface of the substrate or one of the layers prior to depositing the next successive layer thereon to provide at least one surface having a roughness sufficient to substantially suppress the formation of a pattern of light and dark interference fringes upon exposure of the photosensitive imaging member.

25 Claims, 2 Drawing Sheets

METHOD TO SUPPRESS PLYWOOD IN A PHOTOSENSITIVE MEMBER

The present invention relates generally to an imaging system using coherent light radiation to expose a layered member in an image configuration and, more particularly, to a means and method for suppressing optical interference occurring within said photosensitive member which results in a defect that resembles the grain in a sheet of plywood in output prints derived from said exposed photosensitive member when the exposure is a uniform, intermediate-density gray.

There are numerous applications in the electrophotographic art wherein a coherent beam of radiation, typically from a helium-neon or diode laser is modulated by an input image data signal. The modulated beam is directed (scanned) across the surface of a photosensitive medium. The medium can be, for example, a photoreceptor drum or belt in a xerographic printer or copier, a photosensor CCD array, or a photosensitive film. Certain classes of photosensitive medium which can be characterized as "layered photoreceptors" have at least a partially transparent photosensitive layer overlying a conductive ground plane (also referred to as a substrate). A problem inherent in using these layered photoreceptors, depending upon the physical characteristics, is the creation of two dominant reflections of the incident coherent light on the surface of the photoreceptor, e.g., a first reflection from the top surface and a second reflection from the top surface of the relatively opaque conductive ground plane. This condition is shown in FIG. 1 where coherent beams 1 and 2 are incident on a layered photoreceptor 6 comprising a charge transport layer 7, charge generator layer 8, and a ground plane 9. The two dominant reflections are from the top surface of layer 7, and from the top surface of ground plane 9. Depending on the optical path difference as determined by the thickness and index of refraction of layer 7, beams 1 and 2 can interfere constructively or destructively when they combine to form beam 3. When the additional optical path traveled by beam 1 (dashed rays) is an integer multiple of the wavelength of the light, constructive interference occurs, more light is reflected from the top of charge transport layer 7 and hence, less light is absorbed by charge generator layer 8. Conversely, a path difference producing destructive interference means less light is lost out of the layer and more absorption occurs within the charge generator layer 8. The difference in absorption in the charge generator layer 8, typically due to layer thickness variations within the charge transport layer 7, is equivalent to a spatial variation in exposure on the surface. This spatial exposure variation present in the image formed on the photoreceptor becomes manifest in the output copy derived from the exposed photoreceptor. FIG. 2 shows the areas of spatial exposure variation (at 25×) within a photoreceptor of the type shown in FIG. 1 when illuminated by a He-Ne laser with an output wavelength of 633 nm. The pattern of light and dark interference fringes look like the grains on a sheet of plywood. Hence the term "plywood effect" is generically applied to this problem.

The following disclosures may be relevant to various aspects of the present invention.

Tanaka et al., U.S. Pat. No. 4,618,552, discloses a photoconductive imaging member in which the ground plane, or an opaque conductive layer formed above the ground plane, is formed with a rough surface morphology to diffusely reflect the light. Brush polishing is disclosed as a roughening method in col. 6, line 36.

Nagy de Nagybaczon et al., U.S. Pat. No. 4,741,918, discloses a coating process using a buffing wheel.

Kubo et al., U.S. Pat. No. 4,904,557, discloses a photosensitive member comprised of a photosensitive layer on a conductive substrate having a smooth surface, wherein the photosensitive layer has a surface roughness.

Fujimura et al., U.S. Pat. No. 4,134,763, discloses a grinding method to roughen the substrate surface.

Other disclosures of interest include Simpson et al., U.S. Pat. No. 5,096,792; Andrews et al., U.S. Pat. No. 5,051,328; Jodoin et al., U.S. Pat. No. 5,089,908; Herbert et al., U.S. Pat. No. 5,069,758; Fisher, U.S. Pat. No. 4,076,564; and Arai, U.S. Pat. No. 4,537,849.

As discussed in the prior art cited above, a method for compensating for the plywood effect is to provide for a photosensitive imaging member having a roughened surface to diffusely reflect the light. One known method for providing a roughened surface is the liquid honing technique which involves spraying the surface to be roughened with a mixture comprised of water and abrasive particles. Liquid honing, however, is disadvantageous in several respects. One disadvantage arises from the diamond turning or precision extrusion drawing of the substrate prior to liquid honing. In the diamond turning process, a diamond is utilized as a cutting tool while the substrate is rotated at high surface speed (about 20,000 feet per minute) to produce a very smooth, highly reflective surface. Typical surface finishes of about $R_a \approx 0.05$ micron and about $R_t \approx 0.5$ micron are produced. Typically, after diamond turning or extrusion drawing and before liquid honing, the substrate is removed from the lathe or drawing table, lubricant and/or debris resulting from the diamond turning and drawing are removed, and the substrate is cleaned and remounted on a honing machine. This procedure is inefficient since the liquid honing step cannot occur until after the substrate is remounted on the honing machine. Another disadvantage is that a liquid honed surface, such as that involving aluminum substrates, may exhibit a relatively irregular surface texture having angular, sharp shaped features with holes, fissures, and channels. This is due to the impact of the angularly shaped abrasive particles which are used to hone the surface. Accordingly, there is a need for a roughening method which can be used directly after the substrate has been diamond turned or extrusion drawn even in the presence of lubricant and debris. Also, there is a need for a roughening method which provides a surface which is relatively smoother than that attained by liquid honing and results in a very clean surface uncontaminated by particulate debris. The phrase "particulate debris" includes dirt, dust, abrasive particles typically used in liquid honing, extraneous substrate particles resulting from diamond turning or extrusion drawing, or mixtures thereof.

SUMMARY OF THE INVENTION

According to the present invention, the interference effect is at least significantly eliminated by a novel surface roughening process (also described as fiber polishing). The instant process involves forming a photosensitive imaging member by first providing a substrate. An optional intermediate layer, and one or more photosensitive layers are formed in successive layers on the substrate. A conditioning wheel is rotated to roughen the exterior surface of the substrate or one of the layers prior to depositing the next successive layer thereon to provide at least one surface having a roughness sufficient to substantially suppress the formation of a pattern of light and dark interference fringes upon exposure of the photosensitive imaging member.

DETAILED DESCRIPTION

Figure 1:
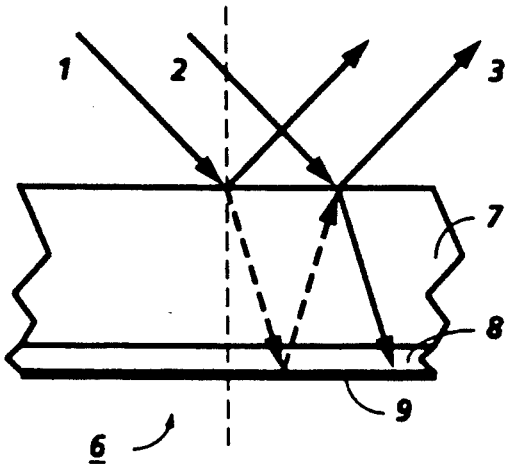
FIG. 1 PRIOR ART
FIG. 1 shows coherent light incident upon a prior art layered photosensitive medium leading to reflections internal to the medium.
Figure 2:
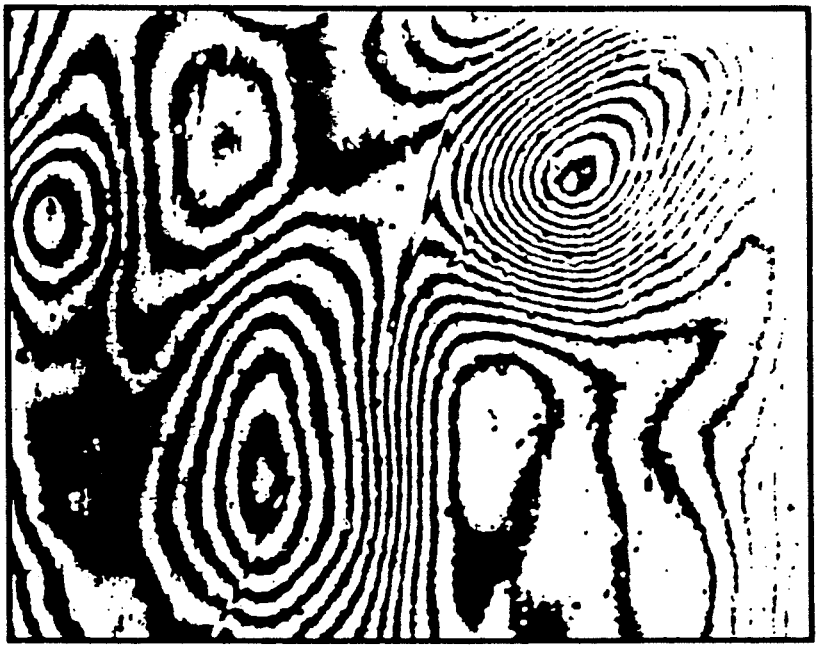
FIG. 2 PRIOR ART
FIG. 2 shows a spatial exposure variation plywood pattern in the exposed photosensitive medium of FIG. 1 produced when the spatial variation in the absorption within the photosensitive member occurs due to an interference effect.

For a general understanding of the features of the present invention, reference is made to the drawings. In the drawings, like reference numerals have been used throughout to designate identical elements.

Figure 3:
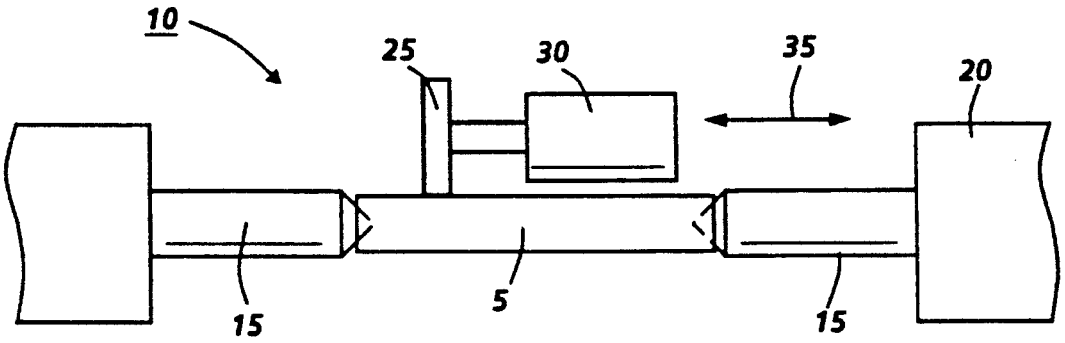
FIG. 3 is a schematic illustration of representative equipment that may be used to accomplish the present invention.

In FIG. 3, substrate 5 is mounted on lathe 10 and is held by holding chucks 15. Motor drive 20 rotates substrate 5. Conditioning wheel 25 is mounted on high speed spindle 30 so that the rim of conditioning wheel 25 contacts the surface of substrate 5. The rim of the conditioning wheel may contact the surface to be roughened at any effective angle, preferably wherein the plane of the wheel is perpendicular to the substrate surface. It is understood that the photosensitive imaging member resulting from the instant invention is not limited to only one roughened surface, but that the conditioning wheel can roughen two or more top surfaces, such as those of the substrate and the intermediate layer or those of the substrate and the photosensitive layer. It is also understood that the conditioning wheel must be applied to the surface to be roughened prior to the deposit of any successive layer. In one preferred embodiment, only the top surface of the substrate is roughened. Wheel 25 and spindle 30 traverse substrate 5 along direction 35. In embodiments, the bare or coated substrate may be mounted on any suitable device such as a lathe and rotated at an effective speed, preferably about 100 to about 3,000 rpm, and more preferably from about 200 to about 1,000 rpm.

Figure 4:
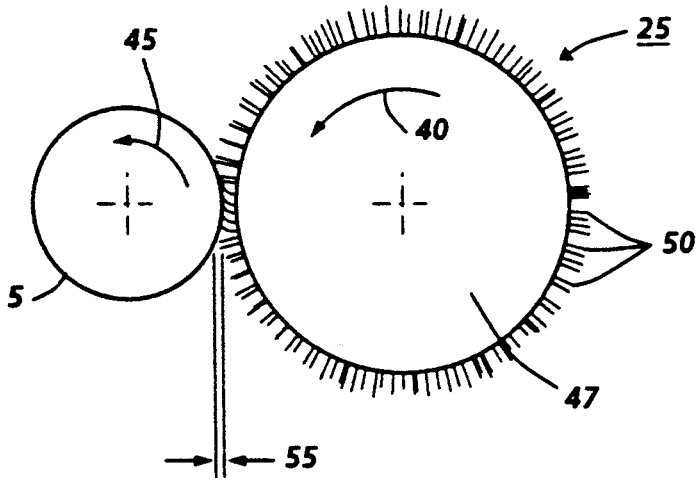
FIG. 4 is a side schematic illustration of the conditioning wheel being applied against the substrate.

FIG. 4 provides more detail on wheel 25 and substrate 5. Conditioning wheel 25 and substrate 5 preferably rotate in counter directions 40, 45 respectively. However, in embodiments, wheel 25 and substrate 5 may rotate in the same direction. Conditioning wheel 25 has two distinct areas. Region 47 is that portion which contains epoxy adhesive or other means such as stitching or clamping devices which join together the various layers of material that constitute the conditioning wheel. Fiber length 50 is that portion which is free of epoxy adhesive or other means that join the various layers of the wheel together. This free fiber length 50 is referred to as "free material" or "free fibers." The free fibers generally face radially outward. As wheel 25 contacts and roughens the surface of substrate 5, the free fibers 50 at the area of contact impact the substrate, wherein the distance that the fiber's length impacts the substrate surface is described as interference 55. The extent of interference 55 may be of any effective length, preferably ranging from about 0.010 to about 0.050 inch, more preferably from about 0.010 to about 0.020 inch, and most preferably about 0.015 inch, where 0.0 inch is defined to be the point where the free fibers are just touching the substrate surface without any bending or compression of the free fibers at the point of contact. The conditioning wheel may be of any effective shape and is preferably disc-shaped.

The roughness of a particular surface may be defined by several parameters, $R_a$ (mean roughness), $R_t$ (maximum roughness depth), $R_{pm}$ (mean levelling depth), $W_t$ (waviness depth), and $P_t$ (profile depth), the definitions of which are well known. $R_a$ is the arithmetic average of all departures of the roughness profile from the mean line within the evaluation length and in embodiments may be any value effective for substantially suppressing plywood, preferably ranging from about 0.05 to about 0.7 micron, more preferably from about 0.1 to about 0.6 micron, and most preferably from about 0.10 to about 0.55 micron. In embodiments, $R_a$ has a value of from about $\lambda/4N$ to about $\lambda/2N$, wherein $\lambda$ is the wavelength of the light source which is directed (scanned) across the surface of the photoreceptor and is from about 600 nm to about 900 nm, preferably from about 700 nm to about 800 nm, and N is an optical index of the photosensitive coatings and has a value from about 1 to about 3, and preferably from about 1.2 to about 2.0. $R_t$ is the vertical distance between the highest peak and the lowest valley of the roughness profile R within the evaluation length and in embodiments may be any value effective for substantially suppressing plywood, preferably ranging from about 0.5 to about 6 microns, and more preferably from about 0.8 to about 4.5 microns. $R_{pm}$ is the mean of five levelling depths of five successive sample lengths and in embodiments may be any value effective for substantially suppressing plywood, preferably ranging from about 0.2 to about 2 microns, and more preferably from about 0.3 to about 1.5 microns. $W_t$ is the vertical distance between the highest and lowest points of the waviness profile W within the evaluation length and in embodiments may be any value effective for substantially suppressing plywood, preferably ranging from about 0.1 to about 1 micron, and more preferably from about 0.15 to about 0.5 micron. $P_t$ is the distance between two parallel lines enveloping the profile within the evaluation length at their minimum separation and in embodiments may be any value effective for substantially suppressing plywood, preferably ranging from about 0.8 to about 6 microns, and more preferably from about 1 to about 4 microns. Significant plywood suppression may be observed in embodiments of the present invention at the light source wavelengths conventionally used, including a light source having a wavelength at 780 nm.

The surface roughness parameters, $R_a$, $R_t$, $R_{pm}$, $W_t$, and $P_t$, can be determined by a Perthen Surface Profilometer Model #S8P, available from Mahr Feinpruef Corp., by utilizing a 5 micron radius contact probe which rides over the surface and directly, by contact, measures the surface contour. An alternate attachment for the Perthen Surface Profilometer Model #S8P can measure the surface by projecting a laser beam onto the surface and measuring the change in focal length observed as the beam scans across the surface. It is understood that other devices and methods equivalent to those disclosed herein may also be employed to measure the various surface roughness parameters.

The peripheral surface speed of the conditioning wheel is determined by the following formula: surface speed=(rotation speed)×(wheel diameter)×pi. Rotation speed is measured in revolutions per minute ("rpm"). The surface speed, the rotation speed, and the wheel diameter may be any suitable value for roughening the the surface of the substrate, the optional intermediate layer, or the photosensitive layer to an effective surface roughness for decreasing the plywood effect. In embodiments, the surface speed of the conditioning wheel is at least 8,000 ft/min, preferably from about 10,000 to about 60,000 ft/min, more preferably from about 20,000 to about 60,000 ft/min, and most preferably from about 25,000 to about 50,000 ft/min. The conditioning wheel may rotate in embodiments at a speed of from about 10,000 to about 400,000 rpm, preferably from about 15,000 to about 100,000 rpm, and more preferably from about 30,000 to about 80,000 rpm. In embodiments, the wheel diameter has a diameter of from about ¾ to about 12 inches, preferably from about 1 to about 8 inches, and more preferably from about 2 to about 6 inches. In embodiments of the present invention, the rotation speed and surface speed of the wheel are sufficiently high to enable the free fibers of the wheel to "flare out." The phenomenon of "flare out" is generally evidenced by a change in noise pitch and a slight drop in rotational speed and is believed to be caused when air currents, generated by the rapidly rotating wheel, fluff the free fibers and cause them to vibrate. "Flare out" of the free material of the conditioning wheel is desired since it is believed to facilitate at least in part the roughening of the surface to the appropriate roughness. "Flare out" of the free fibers, however, is not necessary in every instance to generate the desired surface roughness.

The conditioning wheel has several other parameters. In embodiments, the wheel has a free fiber length of from about 1/16 to about 2 inches, and preferably ⅛ to about ½ inch. The conditioning wheel has a width of any effective value, preferably from about 1/16 to about 2 inches, more preferably ⅛ to about ½ inch. It is also possible to utilize multiple conditioning wheels on multiple spindles which all contact the substrate simultaneously. It is also possible to utilize a wheel which has a width which is equal to the length of the substrate to be conditioned. In this case the wheel need not be traversed along the length of the substrate but simply contacted against the entire length of the rotating substrate for a very short time period. Values outside these specifically recited ranges are encompassed provided the objectives of the present invention are met.

The present invention is not limited to the use of a single wheel. In fact, two or more conditioning wheels may be joined together to form a multi-segment wheel. In a multi-segment wheel, the free fibers of the middle wheels may not "flare out" as well or not at all as compared with the wheels on either end. To improve the air flow characteristics thereby facilitating "flare out," one or more or all of the wheels constituting the multi-segment wheel may be slotted and spaced apart. The slots may be of any suitable shape, number and arrangement. Preferably, there are four elliptically shaped slots arranged in a diamond pattern. The slots may be made by conventional machining with an end mill. In certain embodiments, an air scoop made of any suitable material such as metal, plastic, or composite material may be associated with each slot to further improve the air flow characteristics. The air scoop may be of any suitable shape such as a slat or a curved shape, similar to a louver. Of course, slots and slots with air scoops may also be employed in those embodiments employing only a single wheel.

Several embodiments of the conditioning wheel permit an increase in the width of the surface that can be roughened and therefore an increase in traverse speed. In one embodiment, the wobble wheel, there is provided any effective means to enable the wheel to wobble or oscillate as it rotates. It is believed that an oscillating wheel will roughen a larger surface width than a rigidly mounted rotating wheel. This may be accomplished, for example, by attaching a wedge shaped washer to each side of the buffing wheel. In a second embodiment, the wavey wheel, there is provided a buffing wheel wherein the rim thereof is contoured into an undulating form. The wavey wheel may be made, for example, by taking the epoxy bonded wheel out of the die early, before the epoxy hardens, so that the wheel is soft and pliable. The wheel is then placed into a die with bias spacers positioned at appropriate intervals which offsets the rim from the plane of the wheel into a number of arc-shaped contours. The epoxy in the wheel is then allowed to harden, yielding the wavey wheel. In a third embodiment, the width of the conditioning wheel conforms to the length of the substrate to be conditioned, thereby eliminating the movement necessary with a narrower wheel along the axial direction of the substrate.

The conditioning wheel may be made from any suitable refractory material. Preferably, the refractory material has a melting temperature of from about 1000° F. or above, more preferably from about 2000° to about 5000° F., and most preferably 3000° to about 4000° F. The refractory material also has a hardness of at least about 5 on the Mohs' Scale of Hardness, preferably from at least about 6, and most preferably from about 7 to about 10. The preferred refractory materials are carbon and ceramic fibers. Carbon fiber fabric is available, for example, from Fibre Glast Developments Corp. and is at least 97% pure carbon. Ceramic fiber ($SiO_2$) is available, for example, from Ametek, Haveg Division, Wilmington, Del. as SILTEMP SLEEVING product #S-H-3. It is preferred that the refractory material are monofilaments having a diameter of from about 5 to about 10 microns, especially about 7 to about 8 microns and sufficient tensile strength to withstand the forces imparted by the high speed rotation and subsequent contact with the substrate.

The conditioning wheel may be prepared by any appropriate method. In one embodiment, round discs of the refractory material are cut out from the fabric from which the wheel is to be made. The fabric discs are layered one on top of each other at a 45 degree orientation from one another (assuming a square weave fabric). The number of layers depends on the thickness desired. The fabric layers are then sewn together using a sewing machine in concentric rings. After sewing is complete, the center of the discs is located and a hole is punched through of an appropriate size for a mounting mandrel. The wheel is mounted on a mandrel and rotated at about 1,000 rpm. The edge of the wheel is trimmed with coarse abrasive paper. Progressively finer abrasive papers are then used to finish conditioning of the wheel. In a second embodiment, preparation of the wheel is accomplished similar to the above, except that the fabric layers are pressed together by two circular metal plates instead of being sewn together. In the above embodiments, the free fiber length is that length which extends beyond the stitches or the metal plates. A preferred method for preparing the conditioning wheel using epoxy adhesive is illustrated in the Examples.

The substrate has a surface hardness on the Brinell Hardness Index of about 600 or below, preferably from about 5 to about 400, and most preferably from about 10 to about 80. The substrate can be formulated entirely of an electrically conductive material, or it can be an insulating material having an electrically conductive surface. The substrate is of an effective thickness, generally up to about 100 mils, and preferably from about 1 to about 50 mils, although the thickness can be outside of this range. The thickness of the substrate layer depends on many factors, including economic and mechanical considerations. Thus, this layer may be of substantial thickness, for example over 100 mils, or of minimal thickness provided that there are no adverse effects on the device. In a preferred embodiment, the thickness of this layer is from about 3 mils to about 40 mils. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tim oxide and indium tin oxide, and the like. The substrate layer can vary in thickness over substantially wide ranges depending on the desired use of the electrophotoconductive member. Generally, the conductive layer ranges in thickness of from about 50 Angstroms to 10 centimeters, although the thickness can be outside of this range. When a flexible electrophotographic imaging member is desired, the substrate thickness typically is from about 100 Angstroms to about 0.015 mm. The substrate can be of any other conventional material, including organic and inorganic materials. Typical substrate materials include insulating non-conducting materials such as various resins known for this purpose including polycarbonates, polyamides, polyurethanes, paper, glass, plastic, polyesters such as MYLAR® (available from DuPont) or MELINEX 447® (available from ICI Americas, Inc.), and the like. If desired, a conductive substrate can be coated onto an insulating material. In addition, the substrate can comprise a metallized plastic, such as titanized or aluminized MYLAR®, wherein the metallized surface is in contact with the photosensitive layer or any other layer situated between the substrate and the photosensitive layer. The coated or uncoated substrate can be flexible or rigid, and can have any number of configurations, such as a plate, a cylindrical drum, a scroll, an endless flexible belt, or the like. The outer surface of the substrate preferably comprises a metal oxide such as aluminum oxide, nickel oxide, titanium oxide, and the like. The substrate may be of any diameter conventionally employed in photoreceptors, preferably from about 20 mm to about 650 mm.

One or more intermediate layers may be employed in embodiments of the present invention. The intermediate layer may be any layer conventionally employed between the substrate and the photosensitive layer as illustrated for example in Tanaka et al., U.S. Pat. No. 4,618,552 and Andrews et al., U.S. Pat. No. 5,051,328, the disclosures of which are totally incorporated by reference. Accordingly, the intermediate layer may be a subbing layer, barrier layer, adhesive layer, and the like. The intermediate layer may be formed of, for example, casein, polyvinyl alcohol, nitrocellulose, ethyleneacrylic acid copolymer, polyamide (nylon 6, nylon 66, nylon 610, copolymerized nylon, alkoxymethylated nylon, and the like), polyurethane, gelatin, and the like. In embodiments, intermediate adhesive layers between the substrate and subsequently applied layers may be desirable to improve adhesion. Typical adhesive layers include film-forming polymers such as polyester, polyvinylbutyral, polyvinylpyrrolidone, polycarbonate, polyurethane, polymethyl methacrylate, and the like as well as mixtures thereof. The intermediate layer may be deposited by any conventional means such as dip-coating and vapor deposition and preferably has a thickness of from about 0.1 to about 5 microns.

In embodiments, a charge transport layer and a charge generating layer comprise the photosensitive layers. This is referred to as a laminate type photosensitive material. Charge transport and charge generating layers may be deposited by any suitable conventional technique including dip coating and vapor deposition and are well known in the art as illustrated for example in U.S. Pat. Nos. 4,390,611, 4,551,404, 4,588,667, 4,596,754, and 4,797,337, the disclosures of which are totally incorporated by reference. In embodiments, the charge generation layer may be formed by dispersing a charge generating material selected from azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, and the like; quinacridone pigments; or azulene compounds in a binder resin such as polyester, polystyrene, polyvinyl butyral, polyvinyl pyrrolidone, methyl cellulose, polyacrylates, cellulose esters, and the like. In embodiments, the charge transport layer may be formed by dissolving a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds in a resin having a film-forming property. Such resins may include polycarbonate, polymethacrylates, polyarylate, polystyrene, polyester, polysulfone, styrene-acrylonitrile copolymer, styrene-methyl methacrylate copolymer, and the like.

In embodiments, the photosensitive material may be of a single-layer type comprising the charge generating material, charge transporting material, and the binder resin, wherein these three materials may be as described above. Single layer type photosensitive materials may be deposited by any suitable technique including dip coating and vapor deposition and are illustrated, for example, in Mutoh et al., U.S. Pat. NO. 5,004,662 and Nishiguchi et al., U.S. Pat. No. 4,965,155, the disclosures of which are totally incorporated by reference.

Any suitable high speed spindle may be employed to rotate the conditioning wheel. Examples of appropriate spindles include the Dumore Tool Post Grinder Catalogue #57-031, Model #8526-21° available from Dumore Corporation, Racine, Wis., and Federal Mogul Westwind Division Model #1073 Air Bearing Electric Drive Spindle available from Federal Mogul Corp., Ann Arbor, Mich.

An advantage of the present invention is that in embodiments of the present invention, the substrate surface can be roughened directly after the substrate has been diamond turned or extrusion drawn. As explained earlier, conventionally, the substrate is diamond turned on a lathe or extrusion drawn while using a lubricant. Then the diamond turned or extrusion drawn substrate is taken off the lathe or drawing table to clean off the lubricant and debris. After the cleaning process, the substrate may be put back on to a machine such as a lathe for further finishing of the substrate surface. However, the present invention renders optional the steps of removal of the substrate from the lathe, cleaning, and remounting since the wheel may be applied against the substrate surface even in the presence of lubricant and/or debris. Suitable lubricants for diamond turning the substrate include petroleum solvents such as Exxsol D110 available from Exxon Corp.; Trimsol available from Master Chem Corp. (Trimsol may be mixed with polyethylene glycol in a 50/50 mixture); kerosene, and the like. Suitable non-petroleum based lubricants include Parker Amchem #718 available from Henkel Corp., Michigan.

In embodiments, the fiber polished surface results in improved coating uniformity due to relatively smooth texture of surface and improved wetting of the coating fluid, as well as a precision cleaned surface which results from the cleaning action of the homogeneous fibers impacting the substrate surface and thereby removing particulate debris.

The invention will now be described in detail with respect to specific preferred embodiments thereof, it being understood that these examples are intended to be illustrative only and the invention is not intended to be limited to the materials, conditions or process parameters recited herein. All percentages and parts are by weight unless otherwise indicated.

COMPARATIVE EXAMPLE 1

Roughening by Liquid Honing

Aluminum oxide abrasive particles, having a diameter of up to about 100 microns, are mixed with deionized water at a concentration of 18% by weight to form a honing solution. A 40 mm diameter aluminum substrate is placed on a vertical spindle and rotated at 90 rpm. The honing solution is sprayed from a nozzle onto the substrate surface. As this is done, the nozzle traverses down the length of the substrate at a rate of 0.5 inch per second. when the process is complete, the substrate is cleaned in an ultrasonic-deionized water cleaner.

A substrate surface, liquid honed as described above, exhibited the following surface roughness parameters as determined by a 5 micron radius stylus used on a Perthometer Model #S8P available from Mahr Feinpruef Corporation: $R_a$ of 0.161 micron; $R_t$ of 1.60 microns; $R_{pm}$ of 0.491 micron; $W_t$ of 0.082 micron; and $P_t$ of 1.96 microns. There were angular, sharp shaped features with holes, fissures, and channels. It is believed that these features may be due to the impact of the angularly shaped abrasive particles which are used to hone the surface. In addition, after cleaning off the residual honing media, small particles of fractured media remain imbedded into the substrate surface at occasional random locations.

EXAMPLE 2

Preparation of the Conditioning Wheel

There were provided two circular steel mold plates (base plate and top plate), each having an outside diameter of 6 inches and a through hole of about 1¼ inches in diameter, for preparing the conditioning wheel. The base plate had a concentric projecting rib 4 inches in diameter, wherein the rib was 0.040 inch wide and 0.020 inch high. The projecting rib was to prevent the epoxy from coating the free fibers of the wheel. The base plate was 0.831 inch thick and had 16 small air holes (made by drill plus tap of 10-32 size) arranged at intervals along the inside perimeter of the projecting rib. The top plate was 0.951 inch thick. All components of the mold were cleaned to insure there were no epoxy residue and then sprayed with Teflon mold release spray (Tech Spray 2406-12S dry lube and mold release, available from Tech Spray E. C. Ltd, North Yorkshire, United Kingdom. However, no mold release was sprayed in the area beyond the projecting rib to prevent release spray from coating the free fibers.

A plug with a ⅛ inch hole was inserted in the through hole of the top plate and secured in place with 4 screws. This was where the epoxy adhesive was pumped into the mold. A plug that was filled with epoxy to block off the ⅛ inch hole was inserted into the through hole of the base plate and secured in place with 4 screws.

Sixteen screws that have holes drilled the long way through the center were inserted into the 16 air holes of the base plate. These were vent holes for air evacuation plus indicators showing the epoxy fill progress. Sixteen copper wires of about 3 inches in length were inserted into the screws with the center through holes. The wires were free so that if the mold were tipped upside down, they would fall out of the screws. The wires were to rise or pop-up within the screws as the epoxy begins to follow air out the vent screws.

The base plate was placed on a flat surface with the circular projecting rib facing up. Two ¼ inch dowels were inserted into the holes on the outside diameter of the base plate. These were to align the two plates when placed together. The carbon fiber discs were stacked so that each layer was 45 degrees from the previous layer. The carbon material was about 0.011 inch thick and accordingly 5 layers were stacked together, yielding stacked layers of 0.055 inch thick. The carbon fiber fabric was purchased from Fibre Glast Development Corp. (Dayton, Ohio) in the form of square sheets of 3000 fibers/bundle, 5.6 oz/sq yd, plain weave, 12½ bundles/inch × 12½ bundles/inch construction, and wherein each carbon fiber is about 8 microns in diameter. The top plate was placed over the dowels. This captured the carbon fibers between the two mold plates.

Four stacks of shims were placed 90 degrees from each other between the mold plates. The thickness of the shim pack was determined by the number of layers and the type of material used in the mold. Accordingly, five layers of carbon material required 0.070 inch thickness of shim. Four "C" clamps were placed over the mold and centered over each shim pack. The "C" clamps were tightened evenly around the mold plates. The shim packs kept the two mold plates parallel with each other.

The coupled mold plates were tipped on their side. This allowed access to put the epoxy nozzle tip in the ⅛ inch injection hole in the center of the top plate. This also allowed observation of the copper wire pop-ups for epoxy flow.

The epoxy, Hysol Epoxy Patch ® System #EPS 608 (available from Dexter Corp., Seabrook, NH) was then injected. Injection was stopped after 75% of the wire pop-ups moved. The proper mold assembly typically resulted in a minimum of 75% wire movement. The intent is to stop injection at the earliest opportunity. Overinjection may result in epoxy migration across the projecting rib. The coupled mold plates were placed down, so that the screws and copper wire pop-ups faced up. The copper wire pop-ups were removed immediately after epoxy injection was stopped. The epoxy was cured for at least 12 to 15 minutes. The 16 screws for the copper wires were backed off about 2 turns to insure that the any epoxy inside the screws were broken off. The two mold plates were then separated, with the fiber wheel adhered to the base plate. The fiber wheel was separated from the base plate by using a small flat blade screw driver. Injection sprue was cut off and slag was trimmed. The center plugs were removed from both mold plates. The ¼ inch drill bushing was inserted in the base plate. The fiber wheel was centered on the base plate using the circular projecting rib and the top plate was placed over the wheel. A hole was then drilled in the center of the fiber wheel and the wheel was removed from between the mold plates. Loose fibers were combed from the wheel. The free fibers of the wheel were trimmed to about 1 inch by cutting off the excess fibers. However, a sufficient length of free fiber material remained so that it can later be dressed.

The fiber wheel was rotated at 35,000 rpm on a Dumore grinder and the edges groomed by applying a ½ inch putty knife having a glued strip of 80 grit sand paper against the edges of the wheel. The fiber wheel was then rotated at 42,000 rpm to loosen more fibers and to untangle them. The wheel was groomed again by rotating it at 35,000 rpm and applying a ½ inch putty knife having the glued strip of sand paper against the edges of the wheel. The above grooming procedures were repeated until there were no loose fibers. The resulting conditioning wheel had the following dimensions: about 4 3/16 inches in diameter; about 3/16 inch free fiber length, and about 0.055 inch width.

EXAMPLE 3

Roughening By Fiber Polishing

A 40 mm diameter aluminum substrate, which was previously diamond turned was loaded on a lathe in a manner so that it can be rotated between centers. The substrate was rotated at 240 rpm in a forward turning direction. The high speed spindle holding the rotating carbon fiber wheel (prepared as described in Example 2), rotating at about 42,000 rpm in a direction counter to that of the rotation of the substrate, was positioned so that it was at the left end of the substrate and the buffing wheel was about ¼ inch away from contacting the surface of the substrate. The wheel was moved inward until the first contact was made, indicated by a very slight abrasion on the surface. The inward travel of the wheel was then increased by 0.016 inch and the horizontal traverse was initiated at a speed of 6 inches per minute. The horizontal travel of the wheel was stopped at about ¼ inch from the right end of the substrate.

A substrate surface, fiber polished as described above, exhibited the following surface roughness parameters as determined by a 5 micron radius stylus used on a Perthometer Model #S8P available from Mahr Feinpruef Corporation: $R_a$ of 0.125 micron; $R_t$ of 0.902 micron; $R_{pm}$ of 0.370 micron; $W_t$ of 0.162 micron; and $P_t$ of 1.241 microns. Thus, the surface roughness parameters for the fiber polished surface were determined to be generally smaller than for those of the liquid honed surface of Comparative Example 1, thereby indicating a smoother surface due to fiber polishing. There were rounded wave shaped patterns with no sharp features, no holes, and no fissures or channels. The patterns looked like waves of mountain ranges, directional in nature, of approximately 10 microns peak to peak. Microscopic examination of the carbon fiber tips indicated that there was a deposit of aluminum on each fiber tip resulting from the roughening process. It is speculated that the aluminum residue on the fiber tips during the roughening process may account at least in part for the relative smoothness of the substrate surface. In addition, the resulting surface was extremely clean, requiring no additional cleaning as required in the liquid honing case to remove lubricating medium and particulate debris.

EXAMPLE 4

Preparation of Photoreceptor and Plywood Suppression Test

The photoconductive member was fabricated using the following dip coating procedure and materials: A 40 mm aluminum substrate, fiber polished as described in Example 3, was placed on a holding fixture and lowered into a blocking layer solution made by dissolving nylon 8 into a mixture of methanol, n-butyl alcohol and purified water. The substrate was withdrawn and transferred to a forced air dryer where it was dried for 10 minutes at a temperature of 145° C. resulting in a dry film thickness of 1.50 microns. After cooling to 24° C., this substrate was transferred to a second coating fixture where it was lowered into a photogenerator solution made by dissolving X-Form Metal-Free phthalocyanine and polyvinyl butyral in cyclohexanon. The substrate was withdrawn and transferred to a forced air dryer where it was dried for 10 minutes at 106° C. resulting in a dry film thickness of 0.21 microns. After cooling to 24° C., the substrate was transferred to a third coating fixture, where it was lowered into a charge transport solution made by dissolving N,N'-diphenyl-N,N'-bis(3-methylphenyl)-[1,1'-biphenyl]-4,4'diamine) and poly 4,4'-dihydroxy-diphenyl-1-1 cyclohexanone in monochlorobenzene. The substrate was then withdrawn and transferred to a forced air dryer where it was dried for 56 minutes resulting in a dry film thickness of 19 microns.

The photosensitive imaging member was mounted in a Xerox laser printer model #4213, which is a magnetic brush developing system electrophotographic printer equipped with a helium-neon semiconductor laser with an oscillated wavelength of 633 nm. The scorotron screen voltage was increased from the nominal negative 350 volts to about negative 750 volts. The printer software was adjusted to emulate a 1.0 density solid document. Line scanning was conducted on the whole surface of the photosensitive imaging member to form an image of the whole surface. As a result, no interference fringe pattern appeared in the resulting gray image at all. The suppression of the interference fringes is directly correlated to the suppression that would be shown in xerographic prints made from images formed on the photosensitive imaging member.

Other modifications of the present invention may occur to those skilled in the art based upon a reading of the present disclosure and these modifications are intended to be included within the scope of the present invention.

I claim:

1. A process for forming a photosensitive imaging member comprising:

(a) providing a substrate;

(b) forming in successive layers on the substrate, an optional intermediate layer, and one or more photosensitive layers; and (c) contacting moving refractory fibers in the configuration of a conditioning wheel against the exterior surface of the substrate or one of the layers to provide at least one surface having a roughness sufficient to substantially suppress the formation of a pattern of light and dark interference fringes upon exposure of the photosensitive imaging member.

2. The process of claim 1, wherein the roughening step comprises using the conditioning wheel having a circumferential surface speed of at least about 8,000 ft/min.

3. The process of claim 1, wherein the roughening step uses a conditioning wheel made from a refractory material having a hardness of at least about 5 on the Mohs' Scale of Hardness.

4. The process of claim 1, wherein the roughening step comprises using the conditioning wheel to roughen the surface of the substrate.

5. The process of claim 1, wherein the roughening step comprises rotating the substrate in a direction the same as or opposed to the direction of rotation of the conditioning wheel.

6. The process of claim 1, wherein the roughening step results in the roughened surface being substantially free of debris.

7. The process of claim 1, wherein the roughened surface has a roughness defined by: $R_a$ having a value ranging from about 0.05 to about 0.7 micron; $R_t$ having a value ranging from about 0.5 to about 6 microns; $R_{pm}$ having a value ranging from about 0.2 to about 2 microns; $W_t$ having a value ranging from about 0.1 to about 1 micron; and $P_t$ having a value ranging from about 0.8 to about 6 microns.

8. The process of claim 1, wherein the roughening step comprises using the conditioning wheel having a circumferential surface speed ranging from about 10,000 to about 60,000 ft/min.

9. The process of claim 1, wherein the roughening step comprises rotating the conditioning wheel at a rotation speed ranging from about 10,000 to about 400,000 rpm.

10. The process of claim 1, wherein the roughening step comprises rotating the conditioning wheel at a rotation speed of from about 15,000 to about 100,000 rpm.

11. The process of claim 1, wherein the roughening step comprises rotating the conditioning wheel at a rotation speed sufficient to enable the free fibers of the wheel to flare out.

12. The process of claim 1, wherein the the roughening step comprises using the conditioning wheel having a diameter ranging from about ¾ to about 12 inches.

13. The process of claim 1, wherein the roughening step comprises using the conditioning wheel having a free fiber length ranging from about 1/16 to about 2 inches.

14. The process of claim 1, wherein the roughening step comprises using the conditioning wheel made from carbon or ceramic fibers.

15. The process of claim 1, wherein the roughening step comprises using the conditioning wheel made from a refractory material having a melting temperature of at least 1000° F. or above.

16. The process of claim 1, wherein the providing step provides the substrate having a surface hardness on the Brinell Hardness Index of about 600 or below.

17. The process of claim 1, wherein the providing step provides a substrate made from aluminum, brass, plastic, or nickel.

18. The process of claim 1, wherein the roughening step comprises using the conditioning wheel having a slot therein.

19. The process of claim 18, wherein the conditioning wheel includes an air foil associated with the slot to facilitate air flow.

20. The process of claim 1, wherein the roughening step comprises rotating and oscillating the conditioning wheel.

21. The process of claim 1, wherein the roughening step comprises using the conditioning wheel having an undulated peripheral edge.

22. The process of claim 1, wherein the roughening step comprises using the conditioning wheel having a surface interference distance ranging from about 0.010 to about 0.050 inch.

23. A process for forming a photosensitive imaging member comprising contacting moving refractory fibers against a surface of a layered material deposited on a substrate or against the surface of the substrate devoid of the layered material, thereby roughening the layered material surface or the substrate surface, or both, to substantially suppress the formation of a pattern of light and dark interference fringes upon exposure of the photosensitive imaging member.

24. A process for forming a photosensitive imaging member comprising contacting moving refractory fibers against the surface of a substrate devoid of any layered material, thereby roughening the substrate surface to substantially suppress the formation of a pattern of light and dark interference fringes upon exposure of the photosensitive imaging member.

25. The process of claim 24, further comprising machining the substrate on a lathe prior to the roughening step and accomplishing the roughening step without previously removing the substrate from the lathe.

* * * * *